United States Patent [19]

Buholtz

[11] 4,326,793

[45] Apr. 27, 1982

[54] FULL CANTILEVER STRUCTURAL SUPPORT APPARATUS FOR ROTATABLE ELECTROPHOTOGRAPHIC DRUM

[75] Inventor: William F. Buholtz, Longwood, Fla.

[73] Assignee: Burroughs Corporation, Orlando, Fla.

[21] Appl. No.: 133,577

[22] Filed: Mar. 24, 1980

[51] Int. Cl.[3] ..... G03G 15/00

[52] U.S. Cl. ..... 355/3 DR; 29/123

[58] Field of Search ..... 355/3 R, 3 DR; 29/123

[56] References Cited

U.S. PATENT DOCUMENTS 3,994,053 11/1976 Hunt ..... 355/3 DR X
4,105,345 8/1978 Van Wagner ..... 355/3 DR X
4,134,669 1/1979 Reitner ..... 355/3 DR
4,253,758 3/1981 Cormier ..... 355/3 DR

FOREIGN PATENT DOCUMENTS 425218 10/1974 U.S.S.R. ..... 355/3 DR

*Primary Examiner*—Fred L. Braun
*Attorney, Agent, or Firm*—Carl Fissell, Jr.; Kevin R. Peterson

[57] ABSTRACT

A full cantilever mounting structure for demountably removably supporting a photo-receptor drum for a laser diode printer or other similar apparatus including oppositely disposed orienting members for removably fixedly securing and orienting the drum to a fixed shaft permitting the drum to be freely rotatable about said shaft on demountable end bearings oriented to and removably secured to the fixed shaft.

10 Claims, 2 Drawing Figures

FULL CANTILEVER STRUCTURAL SUPPORT APPARATUS FOR ROTATABLE ELECTROPHOTOGRAPHIC DRUM

BACKGROUND OF THE INVENTION

1. Field of the Invention

The present invention relates to drum mounting apparatus and more particularly to a fully cantilevered mounting apparatus for a rotatably demountable drum.

2. Description of the Prior Art

Prior art mounting apparatus has been both costly to fabricate and relatively complex to mount and dismount and/or replace or repair with the bearings and other associated hardware being fairly difficult to access and attach. Relatively tight tolerances which are required in printing apparatus are difficult to obtain and maintain without extremely costly construction. The present invention reduces these and other problems and lends itself to easy dismounting and/or disassembly for repair, cleaning and replacement.

SUMMARY OF THE INVENTION

The present invention comprises a fully cantilevered photo-receptor drum assembly wherein a rigid, substantially large diameter corrosion free shaft is supported against rotation at one end while the opposite end extends outwardly away from the support and is adapted to support an enlarged rotatable drum member having a photo-receptive external peripheral coating or overlay. Oppositely disposed bearing members permit the drum to freely rotate about the support shaft without contact therewith. Locating pins in each bearing member are engageable with mating locating orifices in the supporting spiders at opposite ends of the drum and enable the drum to be accurately oriented and positioned on the support shaft so as to engage the driven spur gear carried by the inboard bearing member with the input driven pinion gear rotatably supported adjacent the cantilever support member and extending outwardly from an inboard supporting wall structure. The outboard bearing member is demountably removable from the support shaft permitting the drum to be slideably removable from the shaft for service, replacement or repair.

DESCRIPTION OF THE PREFERRED EMBODIMENT

Figure 1:
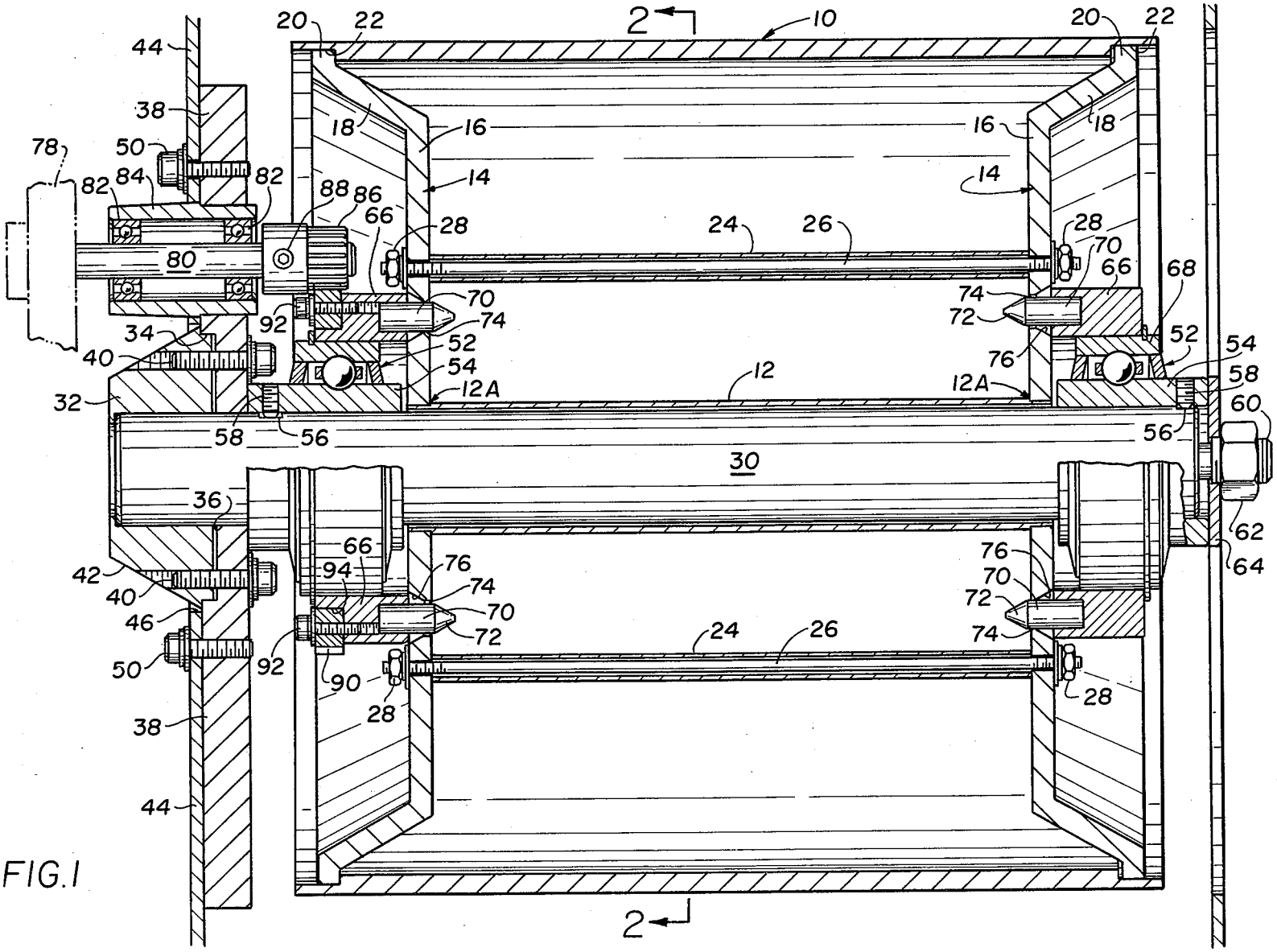
FIG. 1 is a side elevational view of the invention.

The present invention as seen in FIG. 1 comprises a fully cantilevered support and mounting structure for a rotatable member such for example as a photo-receptor for use in printing and/or copying apparatus. However, the inventive concept as described is applicable to any structural arrangement wherein it is necessary or desirable to be able to assemble a rotatable member for example, a drum, to a fixed shaft for rotation thereabout and to be able to easily and quickly dismount the rotatable member without the necessity for the complete removal of basic mounting parts including bearings and other associated hardware, etc.

Referring to FIG. 1, drum 10 as shown is adapted to carry a photo-receptor coating (not shown) for use with an operably associated optical system (not shown) to produce intelligible characters or data thereon in response to applied signal intelligence from a source external to the present apparatus. During the course of operations it may be necessary or desirable that the drum be dismounted from its support as for example, for cleaning, repair and/or replacement. The design of the hardware embodiment of the present invention is such that the drum 10 is easily, quickly and efficiently dismounted and remounted with a minimal effort on the part of the operator utilizing the equipment.

Drum 10 comprises a hollow, cylindrical member substantially open at opposite ends and rotatably supported by means of two spider-like members 14. The outwardly radiating spokes 16 (four for each spider 14) are angularly displaced from the vertical at their outer extremeties as indicated at 18 terminating in a vertical tab or tang 20 each one of which is press fitted to the undercut area 22 of the inner diameter of drum 10. Four equally spaced cylindrical tubular members 24 having the same overall length extend between the confronting faces of the two oppositely disposed spiders 14 and act together with the central, hollow, cylindrical, tubular sleeve 12, with shoulders **12*a* at the same distance apart as the length of members 24, as spacing members therefor. Elongated bolts 26 extend through members 24 to secure the two spiders in structurally rigid spaced relationship by means of nuts 28 threaded to operable ends of each bolt 26**.

As earlier mentioned, the drum 10 is structurally supported on a cantilever beam, i.e., projecting beam structure supported only at one end. An elongated, relatively large diameter, circular shaft 30 is secured against rotation at one end (left in FIG. 1) in a rigid support block 32, and supporting wall 38, the latter including a circular undercut area 34 seated in a mating circular groove 36 in vertically disposed supporting wall 38 as by bolts 40. The external edge portion 42 (leftward in FIG. 1) of member 32 is angled toward the shaft 30. A vertical side plate 44 having an enlarged cutout 46 provides an opening for block 32 which is attached to wall structure 38 as by bolts 40.

Fixed shaft 30, of stainless steel or similar corrosion free material, extends rightwardly away from the cantilever support 32 and projects into and through the central tube or sleeve 12 in cantilever fashion to support drum 10 throughout its length.

At each opposite end of shaft 30 there is disposed a ball bearing member 54 which has an extended inner bearing race in the form of a circular ring-like collar with a set screw 58 for securing attachment member 54 after being slid over shaft 30 to the desired position. Opposite ends of shaft 30 are each provided with a flat 56 adapted to receive the set screw 58 for rigidly orienting and maintaining bearings 54 in the correct relationship with respect to shaft 30 and to the drum 10. The bearing members 54 include seals and shields 52 to protect the bearing from external particles. The rightward end of shaft 30 has a threaded undercut extension 60 which projects rightwardly a short distance as seen in FIG. 1 to receive attaching nut 62. A washer 64 is adapted to seat against the bearing inner race 54 providing longitudinal attachment for the bearing on shaft 30.

An enlarged circular collar-like "locating pin assembly" 66 is press fitted to the outer bearing race 68 of each bearing 54. Two press fitted drum orienting and locating pins 70 are spaced 180° on the outer circumference of each locating pin assembly 66 as seen in FIGS.

Figure 2:
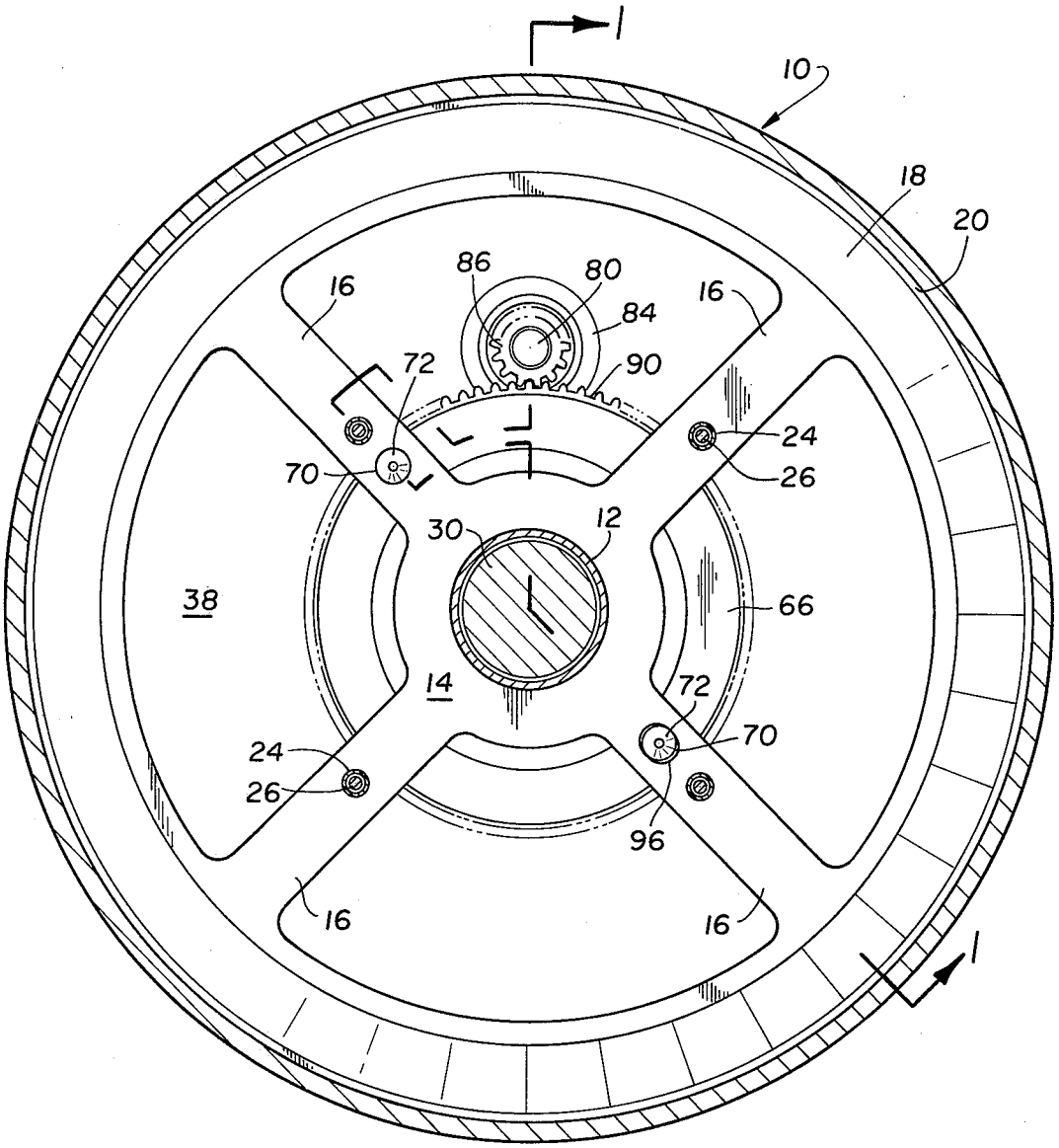
FIG. 2 is an end elevational view illustrating the drive gearing and supporting spider assembly.

1 and 2. The forward projecting end of each pin is tapered as at 72, FIG. 1 for interfitting, telescoping reception within a mating opening or orifice 74 in the central area of each spider 14, the openings 74 being matingly tapered as at 76 for ease of entry, accurate orientation and fit. One of the orifices 96 FIG. 2 on each spider is elongated in a radial direction to reduce tolerance problems.

Input rotative drive is transferred from external pulley system (not shown) to a pulley member 78 drivingly secured to a short horizontal shaft 80 mounted in bearings 82 press fitted into retainer member 84 press fitted to support wall 38.

The forward end of shaft 80 (rightward in FIG. 1) carries a pinion gear 86 affixed thereto by a roll pin or set screw 88. Pinion gear 86 is arranged in driving engagement with an enlarged ring-spur gear 90 secured as by bolts 92 in an undercut 94 on "locating pin assembly" carrying member 66.

Operation: Assembly/disassembly)

Input driving power through pulley 78 rotates shaft 80 and pinion gear 86 in mesh with ring spur gear 90. Spur gear 90 secured to "locating pin assembly" 66 rotates the drum 10 through locating pins 70 and orifices 74 in spider 14. Assuming that the drum 10 requires resurfacing for example, or repair or replacement, it is a simple operation to loosen the nut 62. Backing out the set screw 58 permits removal of bearing 54 carrying the two orienting locating pins or studs 70. The drum 10 may now be physically slid along the shaft 30 since a spacing of 10–15 thousandths clearance exists to permit ease of demounting of the drum. So as to facilitate removal without scratching the surface an extension shaft is screwed onto threads 60. Finally, if need be, the two opposite end spider-spokes 14 can be removed permitting the cylindrical drum shell 10 to be serviced, e.g. resurfaced, replaced or repaired, etc. Note that the rear set of locating pins 70 remain in their originally oriented position. Thus when the drum assembly 10 is remounted onto shaft 30 the tubular guide 12 permits the operator to slide the drum assembly along the shaft 30 until the rear orifices 74 telescopically seat the projecting pins 70 therein accurately orienting the end of the drum on the shaft. The forward end of the drum is now similarly accurately oriented by means of the forwardly projecting pins 70 of the front locating pin assembly 66. Thereafter the nut 62 is tightened along the threaded portion 60 against the retaining washer 64 effectively rigidly positioning drum 10 on shaft 30.

What is claimed is:

1. Mounting apparatus for rotatable drum-like structures permitting rapid, efficient dismounting thereof without detailed parts removal comprising, a rigid, elongated, supporting shaft, means mounting said shaft against rotation with one end thereof rigidly secured and the opposite end thereof projecting freely away therefrom, a rotatable member, means mounting said rotatable member for non-contacting movement about said shaft, orienting means on said rotatable member, orienting means on said mounting means matingly engageable with said orienting means on said rotatable member for positioning said rotatable member parallel to said shaft, drive means engaging said rotatable member for effecting rotation thereof, and means operably engaging said shaft and said mounting means permitting said rotatable member to be mounted on and dismounted from said shaft without requiring precise fit and adjustment of said rotatable member relative to said shaft while maintaining parallelism between said shaft and said rotatable member.

2. The invention in accordance with claim 1, wherein said rigid supporting shaft is rigid, elongated, stainless steel member including a reduced, threaded end portion engageable with fastening means for retaining the rotatable member mounting means on said shaft.

3. The invention in accordance with claim 1, wherein said elongated shaft is provided with oppositely disposed flats each one of which is engageable with an individual retaining member for orienting and positioning said mounting means along said shaft.

4. The invention in accordance with claim 1, wherein one of said mounting means includes a driven member operably engageable with said drive means for transmitting rotative motion to said rotatable member.

5. The invention in accordance with claim 1, wherein said rotatable member comprises a cylindrical drum having a photo-receptive coating or surface thereon and including a central, coaxial, cylindrical member extending from end to end thereof for guiding said rotatable member along said supporting shaft when said rotatable member is mounted to and dismounted from said shaft.

6. The invention in accordance with claim 4, wherein said drive means for said rotatable member is slideably engageable with said driven member permitting said rotatable member to engage said drive means as said rotatable member is slideably mounted on said supporting shaft.

7. The invention in accordance with claim 1, wherein said orienting means includes a plurality of individual projections extending outwardly away from said mounting means and wherein said rotatable member is provided with a like plurality of receiving orifices matingly engageable with said projections for accurately locating said rotatable member on said supporting shaft without tilting or cocking relative to the axis of said shaft.

8. The invention in accordance with claim 7, wherein said receiving orifices are non-circular in configuration.

9. The invention in accordance with claim 1, wherein said rotatable member is an open ended cylindrical drum having oppositely disposed radiating spoke-like members and a central, hollow, tubular member interconnecting said spoke-like members and wherein said supporting shaft carries oppositely disposed bearing members demountably fixed to said shaft, each of said bearing members carrying a plurality of forwardly projecting pin-like members for telescopic mating engagement with orifices in said spoke-like members effective to accurately locate said drum along said shaft without contact between said tubular member and said shaft.

10. The invention in accordance with claim 1, wherein said shaft mounting means comprises a rigid, substantially thick, circular member secured to a vertical structural supporting member and wherein said circular member is provided with a circular mating opening engaging said shaft effectively forming a full cantilever support for said shaft at one end thereof with the opposite end projecting freely away therefrom.

* * * * *